US009452607B2

(12) United States Patent
Kuypers et al.

(10) Patent No.: US 9,452,607 B2
(45) Date of Patent: Sep. 27, 2016

(54) ASSEMBLY OF A PRINT HEAD AND A MAINTENANCE UNIT AND METHOD FOR THE USE OF SAID ASSEMBLY

(71) Applicant: OCE-TECHNOLOGIES B.V., Venlo (NL)

(72) Inventors: Laurentius P. E. G. Kuypers, Someren (NL); Patrick Vink, Broekhuizenvorst (NL); Jan P. J. Verstegen, Sevenum (NL); Emil Spee, Hegelsom (NL); Frank J. W. Zeelen, Maasbree (NL); Martinus H. Caris, Weert (NL); Ludovicus M. Heijnders, Landgraaf (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/703,635

(22) Filed: May 4, 2015

(65) Prior Publication Data

US 2015/0298475 A1 Oct. 22, 2015

Related U.S. Application Data

(63) Continuation of application No. PCT/EP2013/072409, filed on Oct. 25, 2013.

(30) Foreign Application Priority Data

Nov. 19, 2012 (EP) ..... 12193180

(51) Int. Cl.
*B41J 2/165* (2006.01)
*B41J 29/393* (2006.01)

(52) U.S. Cl.
CPC ..... *B41J 2/16552* (2013.01); *B41J 2/16517* (2013.01); *B41J 2/16535* (2013.01); *B41J 2/16541* (2013.01); *B41J 29/393* (2013.01); *B41J 2002/1655* (2013.01); *B41J 2002/16573* (2013.01)

(58) Field of Classification Search
CPC ..... B41J 2002/1655; B41J 2/16552
See application file for complete search history.

(56) References Cited

U.S. PATENT DOCUMENTS

| | | | | |
|---|---|---|---|---|
| 2004/0036735 | A1 | 2/2004 | Garbacz et al. | |
| 2004/0218002 | A1 | 11/2004 | Nakamura | |
| 2010/0245466 | A1 | 9/2010 | Inoue | |
| 2010/0315463 | A1 | 12/2010 | Escude et al. | |
| 2012/0050394 | A1 * | 3/2012 | Takada | B41J 2/16535 347/27 |

FOREIGN PATENT DOCUMENTS

| | | | | |
|---|---|---|---|---|
| EP | 0 576 175 | A2 | | 12/1993 |
| EP | 1 013 453 | B1 | | 6/2007 |
| JP | 2002234195 | A | * | 8/2002 |
| JP | 2009178867 | A | * | 8/2009 |
| JP | 2011161845 | A | * | 8/2011 |
| JP | 2013233657 | A | * | 11/2013 |
| WO | WO 2011/099230 | A1 | | 8/2011 |

* cited by examiner

*Primary Examiner* — Shelby Fidler
(74) *Attorney, Agent, or Firm* — Birch, Stewart, Kolasch & Birch, LLP

(57) ABSTRACT

The present invention relates to an assembly of a print head and a maintenance unit. The present invention further relates to a method for the use of an assembly of a print head and a maintenance unit.

10 Claims, 4 Drawing Sheets

ASSEMBLY OF A PRINT HEAD AND A MAINTENANCE UNIT AND METHOD FOR THE USE OF SAID ASSEMBLY

The present invention relates to an assembly of a print head and a maintenance unit, wherein the print head comprises a nozzle plate, the nozzle plate comprising at least one nozzle arranged therein; and wherein the maintenance unit comprises a web impregnated with a maintenance fluid, the web being configured to wipe across the nozzle plate of the print head when the web contacts the nozzle plate, the maintenance unit further comprising moving means to move the web with respect to the nozzle plate, the maintenance unit further comprising wetting means for wetting the web with the maintenance fluid;

The present invention further relates to a method for the use of an assembly of a print head and a maintenance unit.

BACKGROUND OF THE INVENTION

Deterioration of jetting properties of an inkjet printing device (inkjet head of print head) is a known problem in the art. It is also known that nozzle clogging of inkjet heads with dried ink residues and depositions of dried ink residues on a nozzle plate near the nozzles cause jetting properties to deteriorate. Ink residues causing nozzle clogging and depositions of these residues are generated due to evaporation of solvents from the ink composition present in the nozzles and on the nozzle plate. Moreover, also fluid ink droplets present on a nozzle plate may cause jetting problems, e.g. when they are present close to a nozzle. Deposition of ink residues (solid or fluid) may be caused, for example, by spilling ink during the printing process. Alternatively, during a period of inactivity of a printer, the liquid vehicle of an ink composition may evaporate, leading to the formation of solid residues in and around the nozzle.

It is known to remove solid ink residues deposited on the nozzle plate by wiping, e.g. by wiping using a web provided with a fluid. In addition, it is known that wiping using a web provided with a fluid may be used to prevent drying of the ink. For example, US 2010/0315463 describes a device and a method to service a print head using a web impregnated with a fluid that forms a protective coating and slows down evaporation of the ink, thereby slowing down the formation of solid ink residues in the nozzle. However, the fluid forming the protective coating evaporates, albeit at a slow rate. Therefore, if a longer period of inactivity is foreseen, then application of the protective coating may not suffice to prevent ink from evaporating and forming solid residues, during the period of inactivity.

It is therefore an object of the invention to provide an assembly of a print head and a maintenance unit that prevents the nozzle clogging more efficiently. In addition, it is an object of the invention to provide an assembly of a print head and a maintenance unit that is able to perform a suitable maintenance action, based on the condition of the print head.

It is a further object of the invention to provide a method for maintaining a print head that prevents the nozzle clogging more efficiently.

An object is achieved in an assembly of a print head and a maintenance unit for maintaining the print head, the print head comprising a nozzle surface, the nozzle surface comprising at least one nozzle arranged therein;

the maintenance unit comprising a web, the web being configured to wipe across the nozzle surface of the print head when the web contacts the nozzle surface, the maintenance unit further comprising moving means to move the web with respect to the nozzle surface, the maintenance unit further comprising wetting means for wetting the web with a maintenance fluid;

the assembly being further provided with a control unit configured to control the maintenance unit and the print head, wherein the control unit is configured to, based on a condition of the print head, apply a maintenance action to the print head using the maintenance unit.

The assembly according to the present invention may comprise a print head. Print heads may be used in inkjet printers to expel droplets of a fluid onto a receiving member. The print head may comprise a nozzle surface, which comprises a nozzle. Optionally, the nozzle surface may be provided with an anti-wetting coating. Ink is ejected through the nozzle onto the receiving member. When jetting droplets of ink, ink may be spilled on the nozzle surface. Ink present on the nozzle surface may interact with ink that is ejected through the nozzle, thereby influencing the jetting performance of the print head. It is preferred to remove ink from the vicinity of the nozzle in order to prevent the jetting performance being influenced by ink present on the nozzle surface. Thus, the nozzle may form an opening which connects the interior of the print head with the exterior of the print head. Therefore, the nozzle may be in communication with the atmosphere around the print head. When the print head is inactive for a certain period of time, volatile components may evaporate from the ink present in and in proximity of the nozzles. This may result in thickening of ink and possibly even formation of solid depositions in and around the nozzle. Thickening of ink and solid depositions may negatively influence the jetting performance when the print head is re-activated. To prevent the jetting performance from being negatively influenced by the presence of thickened ink and/or ink residues, it may be necessary to apply a maintenance action to the nozzle surface of the print head.

The assembly according to the present invention is provided with a maintenance unit. The maintenance unit may be provided with a web. The web may be made of a woven material, such as a woven non-polymeric material or a woven polymeric material, e.g. a woven polyester material, or a non-woven material, such as a non-woven polymeric material or a non-woven non-polymeric material. The web may be made of an absorbing material. An absorbing material may e.g. absorb liquid ink present on the nozzle plate. By contacting the nozzle plate with the web, the web may locally absorb the fluid and thereby locally clean the nozzle surface.

The maintenance unit may further comprise moving means to move the web with respect to the nozzle surface. The moving means may be configured to move the web towards the nozzle surface of the print head to bring the web and the nozzle surface into contact with one another. In addition, the moving means may be further configured to move the web away from the nozzle surface. The moving means may be configured to move the complete web, or alternatively, only a part of the web may be moved.

The web may be engaged by rollers. For example, the web may be engaged by a web supply roller and a web uptake roller. The web supply roller may comprise a part of the web that is not yet used in a maintenance action. This part of the web may be wound around the web supply roller. The web may be further engaged by the web uptake roller. The web uptake roller may engage the part of the web that has already been used in a maintenance action. This part of the web may be wound around the web uptake roller. A part of the web may be positioned in between the two rollers. This part may be e.g. the part of the web that is used in the maintenance action. This intermediate part may optionally be further engaged by web engaging means. This engaging means may optionally be used to move the intermediate part of the web relative to the nozzle surface of the print head. Further, the engaging means may be used to push the web against the nozzle surface. The rollers and/or the engaging means may provide tension to the web. The web may be configured to wipe across the nozzle surface of the print head when the web contacts the nozzle surface. By wiping across the nozzle surface, the nozzle surface may undergo a maintenance action.

The maintenance unit may further comprise wetting means for wetting the web with a maintenance fluid. The wetting means may wet the web. By wetting the web, the web may become better suited to perform certain maintenance actions, as will be discussed in more detail below. The wetting means may be suitably selected and may be selected from e.g. a reservoir containing the maintenance fluid, the reservoir being configured such that the web may be led through the reservoir; a spray unit, such as a nozzle configured to jet the maintenance fluid onto the web, or a wettable roller configured to guide the web, thereby wetting the web. The wettable roller may be e.g. a roller comprising a surface that is capable of absorbing the maintenance liquid. The wettable roller may be positioned in proximity of a reservoir containing the maintenance fluid, such that a part of the absorbing layer of the roller is submerged in the maintenance liquid. The roller may be configured to contact the web. When the roller rotates, e.g. upon movement of the web, a wetted part of the web may be moved towards the web and the web may be wetted.

The assembly according to the present invention may be further provided with a control unit configured to control the maintenance unit and the print head, wherein the control unit is configured to, based on a condition of the print head, apply a maintenance action to the print head using the maintenance unit. Whether it is necessary to perform a maintenance action may depend on the condition of the print head. For example, if there is solid deposition on the nozzle surface, it may be necessary to perform a maintenance action. In addition, the amount of time lapsed after a previously performed maintenance action may be taken into account. Furthermore, an upcoming standby period of the print head may be taken into account. Also the type of maintenance action that is best performed may depend on the condition of the print head. The control unit may select a maintenance action to be carried out on the print head using the maintenance unit. In this way, the print head may be maintained in an efficient way. A maintenance action may not be carried out unnecessary and it may be prevented that an ineffective maintenance action is carried out.

The control unit may be e.g. a computer. The control unit may be configured to receive information from an external source, e.g. via a USB-port or via a network. The control unit may e.g. receive information about the current and future activity of the print head. Moreover, the control unit may receive data concerning the condition of the print head. The data concerning the condition of the print head may be generated e.g. by the print head itself or may be generated by suitable print head status monitoring means, such as a camera system. Alternatively or additionally, the data concerning the condition of the print head may be derived from analysis of a printed image, for example analysis by a scanner. For example, the condition of the print head may be deducted by analysis of a printed image or a spitting pattern.

The control unit may select the maintenance action from a group of pre-defined maintenance actions. The group of pre-defined maintenance actions may e.g. consist of a conservation action, a first cleaning action and a second cleaning action.

In an embodiment, the maintenance action is a conservation action for preventing drying of ink due to evaporation of ink from the at least one nozzle in the nozzle surface, by supplying the nozzle with the maintenance fluid.

The nozzle may be open to atmosphere. Therefore, volatile components of the ink may evaporate in time, thereby drying the ink. Drying of the ink may thicken the ink and possibly solid depositions may be formed. The presence of thickened ink and/or solid depositions in and/or in proximity of the nozzle may hamper jetting efficiency. For example, a nozzle may be blocked, preventing the ejection of a droplet. Alternatively, full or partial blocking of a nozzle may cause artifacts such as jet angle deviation, droplet size variation, satellite droplets etc. Therefore, it is preferred that evaporation of the ink is prevented. This may be done by applying a conservation action to the print head. During the conservation action, maintenance fluid may be supplied to the nozzle. Preferably, the maintenance fluid is provided into the nozzles. The maintenance fluid may preferably be a non-volatile fluid. A non-volatile fluid may not or hardly evaporate. This may prevent drying. The maintenance fluid may be compatible with the ink composition. In that case, the maintenance fluid may mix to some extent with the ink. Mixing may take place spontaneously, for example due to diffusion. Alternatively, mixing may be enhanced, as will be described below with respect to the method for performing the conservation action. The conservation action may be applied to the print head by the control unit, for example when the control unit receives information that a period of inactivity of the print head is scheduled.

In an embodiment, the maintenance action is a first cleaning action for removing liquid material from the nozzle surface. Liquid material may be present on the nozzle surface. This may result from e.g. satellite droplets or contact between a receiving member and the nozzle surface of the print head. Presence of liquid material on the nozzle surface may negatively influence the jetting performance of a print head. For example, presence of liquid material may influence droplet formation and may therefore influence properties of a droplet generated by the print head, such as the jetting angle of the droplet. Furthermore, in time, liquid material may dry and may form solids on the nozzle surface. These solids may also negatively influence jetting performance. When presence of liquid material on the nozzle surface is detected, the control unit may apply a first cleaning action to the nozzle surface, as a maintenance action. In the first cleaning action, the web may be brought into contact with the nozzle surface. The web may then absorb the liquid present on the nozzle surface, thereby removing the liquid from the nozzle surface. The web may be moved along the nozzle surface, thereby cleaning the entire nozzle surface. Alternatively, the web may not be moved and may only locally contact the nozzle surface. This may suffice to clean the nozzle surface in case liquid material is only locally detected.

When the web is moved along the nozzle surface, the part of the web contacting the nozzle surface may be refreshed. For example, if the web is wound around a supply roll and a web uptake roll, a part of the web on the supply roll may be unwound and a corresponding quantity of the web may be wound around the web uptake roller. By refreshing the web when wiping, it may be prevented that contaminations may be smeared over the nozzle surface. Instead, the contaminants may be absorbed by the web and may not come into contact with the nozzle surface anymore.

In the first cleaning action, the web may be dry or some maintenance liquid may be applied onto the web, depending on the conditions, e.g. type and amount of liquid material present on the nozzle surface, properties of the maintenance liquid, etc.

In an embodiment, the maintenance action is a second cleaning action for removing solid material from the nozzle surface. When operating a print head, the nozzle surface may be polluted by ink, as is described above with regard to the first cleaning action. In time, this ink may dry, and consequently, solid material may be formed on the nozzle surface. The nozzle surface may also be polluted by particles of the receiving member, e.g. paper dust, due to contact between the nozzle surface and the receiving member or due to the presence of these particles in the atmosphere surrounding the print head. In order to remove solid material from the nozzle surface, it may not suffice to contact the web and the nozzle surface, since solid material may not be absorbed by the web. In order to efficiently remove solid material from the nozzle surface, the web may be wetted with a suitable maintenance liquid. Thus, when the second cleaning action is performed, the web may be wetted by the wetting means. The maintenance liquid may be e.g. a liquid equal or similar to the vehicle of the ink composition. When the maintenance liquid mimics the vehicle of the ink composition, solid material deposited on the nozzle surface by drying of ink may be redissolved in the maintenance liquid. The resulting liquid—i.e. maintenance liquid with solid material dissolved therein—may be absorbed by the web and may thus be removed from the nozzle surface by contacting the nozzle surface with the web.

In an embodiment, the control unit is configured to, based on a condition of the print head, selectively apply at least one of the maintenance actions selected from the group consisting of the conservation action, the first cleaning action and the second cleaning action. As described above, a plurality of maintenance actions may be available to maintain and/or conserve the nozzle surface of a print head. In order to efficiently operate the print head, it is preferred that maintenance and conservation is only performed when this is required by a condition of the print head. In addition, it is also preferred that a suitable maintenance action is performed; e.g. that the second cleaning action is performed when solid material is present on the nozzle surface. The control unit may be operatively connected to a detection means configured to detect a condition of a print head. The detection means may be e.g. optical detection means that detect the condition of the print head based on visual condition of a print head, such as a camera. Alternatively, the detection means may be electrical detection means. The electrical detection means may detect an electrical signal, based on which the condition of the print head may be deducted. Optionally, the electrical detection means may involve the print head itself. For example, if the print head comprises a piezoelectric actuator, a residual pressure, generated after the ejection of a droplet, induce an electric current (wave) in the piezo-electric actuator. This electric current wave may be detected and based on properties of the wave (e.g. amplitude, frequency and damping), the condition of the print head may be deducted. Deducting the condition of a print head in such a way is known e.g. from EP 1013453 B1. The control unit may be configured to apply a maintenance action to the print head, based on the condition of the print head. For example, when solid material is detected on the nozzle surface, the second cleaning action may be applied. The control unit may then control the moving means to bring web into contact with the nozzle surface. Optionally, the control unit may control the moving means to move the web along the nozzle surface. The control unit may then control the wetting means of the maintenance unit to wet the web, for example by spraying the maintenance fluid onto the web. Optionally, the control unit may control the amount of fluid sprayed onto the web based on the condition of the print head. For example, the more solid material is present on the nozzle surface, the more maintenance fluid may be applied onto the web. The control unit may apply a plurality of maintenance operations to the print head. For example, when solid material is detected on the nozzle surface and a period of inactivity is envisaged, the control unit may control the maintenance unit to apply a second cleaning action to the print head and subsequently apply a conservation action to the print head. The control unit may control whether a print job is paused in order to apply a maintenance action to the print head or may control a print job to be finished and subsequently apply a maintenance action.

In a further embodiment, the assembly further comprises a camera system configured to determine the condition of the print head. A camera may be applied to monitor the print heads and may thus be used to determine the condition of a print head. For example, in case there is contamination present on the nozzle surface, such as liquid and/or solid contamination, this may be observed using the camera. Interpretation of the data obtained using the camera may be done automatically, such as by using a suitable computer program, or may be done by an operator. Based on the condition of the print head, a suitable maintenance action may be applied.

In an embodiment, the maintenance fluid is a low volatile fluid. Using a low volatile fluid as a maintenance fluid may be especially advantageous for use in the conservation action. In the maintenance action, the maintenance fluid may be applied onto the nozzle surface of the print head in order to prevent drying of the ink. When the maintenance fluid is a low volatile fluid, the fluid does not or hardly evaporate. Consequently, a layer of the maintenance fluid applied onto the nozzle surface may not disappear from the nozzle surface, and thus the protective layer formed by the maintenance fluid may not be lost. Thus, using a low volatile fluid as the maintenance fluid may improve efficiency of the conservation action. Examples of low volatile fluids are glycerol, diethylene glycol, triethylene glycol, tetraethylene glycol, polyethylene glycol, diproplylene glycol, glycol ethers, 2-pyrrolidone, 3-pyrrolidone, N-methylpyrrolidone, betaine, dimethyl sulfoxide. Optionally, mixtures of these solvents may be used as a maintenance fluid.

In a further embodiment, a second maintenance fluid may be provided. For example, the second maintenance fluid may be a volatile fluid. Use of a volatile fluid may be advantageous, for example in a second cleaning action for removing solid material from the nozzle surface. In a second cleaning action, the web may be wetted and when it is wetted with a volatile fluid, wiping along the nozzle surface with the web may dissolve solid residues on the nozzles surface, thereby removing these residues. After the nozzle surface has been wiped, some fluid from the web may be present on the nozzles surface. When this fluid is volatile, it may quickly evaporate, thereby disappearing from the nozzle surface. When the fluid has disappeared, it may be prevented that the fluid hampers the jetting process.

In an aspect of the invention, a method for maintaining a print head is provided, the method comprising the steps of:

a) determining a condition of the print head;

b) based on the condition of the print head, selecting a maintenance action from the group consisting of:

a conservation action for preventing drying of ink due to evaporation of ink from the at least one nozzle in the nozzle surface, by supplying the nozzle with the maintenance fluid;

a first cleaning action for removing liquid material from the nozzle surface; and a second cleaning action for removing solid material from the nozzle surface;

c) applying the maintenance action selected in step b) to the print head using a maintenance unit, the maintenance unit comprising a web, the web being configured to wipe across the nozzle surface of the print head when the web contacts the nozzle surface, the maintenance unit further comprising moving means to move the web with respect to the nozzle surface, the maintenance unit further comprising wetting means for wetting the web with a maintenance fluid.

In order to efficiently operate the print head, it is preferred that maintenance and conservation is only performed when this is required by a condition of the print head. In addition, it is also preferred that a suitable maintenance action is performed; e.g. that the second cleaning action is performed when solid material is present on the nozzle surface. Hence, in step a) the condition of the print head is determined. The condition of the print head may be determined using suitable detection means, as described above. The detection means configured to detect a condition of a print head may be operatively connected to the control unit.

In step b) a maintenance action may be selected, wherein the maintenance action may be selected from the group consisting of a conservation action, a first cleaning action and a second cleaning action.

In step c), the maintenance action selected in step b) is applied to the print head. The method may be performed e.g. by the assembly of the print head and the maintenance unit according to the present invention, which is described above.

In an embodiment, in step b), the conservation action is selected as the maintenance action; and wherein in step c) the method comprises the steps of:

i. applying an amount of maintenance fluid to the web using the wetting means;

ii. moving the web towards the nozzle surface using the moving means, such that the web contacts the nozzle surface at least at the position of the at least one nozzle;

iii. applying an under pressure to the at least one nozzle, thereby sucking the fluid from the web into the at least one nozzle.

The conservation action may be applied to the nozzle surface of the print head by a method comprising the steps i), ii) and iii). In step i), an amount of maintenance fluid may be applied to the web using the wetting means. The wetting means may be configured to wet the web and may comprise e.g. a spray nozzle for spraying maintenance liquid onto the web or a reservoir configured to contain the maintenance fluid and web guiding means for guiding the web though the reservoir. The wetting means may provide the web with a suitable amount of the maintenance liquid.

In step ii), the web may be moved towards the nozzle surface. The web may be moved such that the web contacts the nozzle surface at least at the position of the at least one nozzle. By contacting the nozzle surface with the web, maintenance liquid may be transferred from the web to the nozzle surface, thereby at least locally applying a layer of the maintenance liquid to the nozzle surface. In addition, some maintenance liquid may be provided in the nozzle. By applying an amount of maintenance liquid to the nozzle, evaporation of ink through the nozzle may be diminished or even prevented. When contacting the web and the nozzle surface, the web may be pressed against the nozzle surface. By pressing the web, the maintenance liquid may be transferred to the nozzle surface more efficiently.

In step iii), an under pressure may be applied to the at least one nozzle. This at least one nozzle may be in contact with the wet web. By applying an under pressure to the at least one nozzle that is in contact with the web, the maintenance fluid may be sucked from the web into the at least one nozzle. By sucking the fluid into the nozzle, more maintenance liquid may be transferred into the nozzle and evaporation of the ink vehicle through the nozzle may be prevented more efficiently. An under pressure may be applied to the nozzle by applying an under pressure using the print head.

In an embodiment, the at least one nozzle is in fluid communication with an ink chamber, the ink chamber being positioned in the print head, wherein the print head is provided with at least one actuation unit configured to actuate a fluid present in the ink chamber, wherein the under pressure is applied by the actuation means.

In a print head, droplets of ink may be ejected through a nozzle. In order to eject a droplet, a quantity of ink present in an ink chamber may be actuated, thereby generating a pressure change in the ink in the ink chamber. The ink chamber may be in fluid communication with the nozzle. The ink in the ink chamber may be actuated using suitable actuation means. The most commonly used actuation means are thermal actuation means and piezo-electric actuation means. In case piezo-electric actuation means are used, applying a voltage to a piezoelectric element may result in the flexure of the piezoelectric element, said flexure resulting in a volume change of the ink chamber, leading to a pressure change in the ink present in the fluid chamber.

Generally, when actuating a liquid, a voltage is applied such that the volume of the fluid chamber decreases, thereby increasing the pressure of the fluid. However, by applying a voltage in an opposite direction, the piezoelectric element may flex such that the volume of the fluid chamber increases. The volume increase of the fluid chamber may result in an underpressure in the fluid chamber. In the conservation action, the wetted web may be in contact with the nozzle surface and may be in contact with a nozzle. When, at that moment, an underpressure is applied, the fluid may be transferred from the web into the nozzle. More maintenance fluid may be brought into the nozzle, thereby preventing nozzle clogging more efficiently.

In an embodiment, the method further comprises the step of:

iv) applying a mixing pulse to the actuation means, thereby putting a fluid in the ink chamber in motion to mix the fluid sucked from the web with fluid in the ink chamber.

In an embodiment, a mixing pulse may be applied to the actuation means. The mixing pulse may be used to bring the meniscus of the fluid present in the nozzle in motion without expelling a droplet. For example, if the actuation means comprises a piezoelectric actuator, the actuator may be flexed to such extent, that a relatively small volume change is imparted to the fluid chamber. This volume change may not suffice to eject a droplet through the nozzle, but may put the fluid in the ink chamber in motion. Due to the motion of the fluid in the ink chamber, the fluid in the nozzle may also be put into motion. Consequently, mixing between the maintenance fluid introduced in the nozzle and the ink in the fluid chamber may take place.

In a further embodiment, step iii) is repeated after step iv) has been performed. By repeating step iii) after step iv) is performed, more maintenance fluid may be introduced into the nozzle and possibly within the fluid chamber of the print head. By introducing more maintenance liquid through the nozzle, the nozzle—and thus the print head—may be more efficiently conserved. The more maintenance liquid is introduced, the more evaporation of the ink may be prevented. For example, the maintenance liquid may comprise low volatile solvents, which hardly evaporate. In addition, by introducing maintenance liquid which partially replaces the ink, such as a latex ink, the amount of dispersed particles present in the nozzle and the fluid chamber may decrease, thereby reducing the amount of particles which may possibly precipitate upon evaporation of the solvents. For example, the maintenance liquid may be essentially free from components, which after evaporation of the vehicle of the maintenance liquid, form solid residues. Thus, the maintenance liquid may not contribute to the formation of solid residues, which may result in nozzle clogging.

Step iii) and step iv) may be optionally repeated a number of times. In addition, the nozzle surface of the print head may be capped after the conservation action is finished. Capping may further reduce evaporation of liquids from the nozzles.

In an embodiment, the maintenance fluid and the fluid in the ink chamber are miscible. When the maintenance fluid and the fluid in the ink chamber are miscible, no phase separation may occur when the ink in the ink chamber and the maintenance fluid are mixed, for example by applying a mixing pulse. Thus, more maintenance liquid may be introduced by using a maintenance liquid miscible with the fluid in the ink chamber. The more maintenance liquid is introduced, the more the ink composition may be diluted. When the ink composition is diluted, evaporation of liquid through the nozzle may be less likely to cause precipitation of solid particles upon evaporation of liquid.

In a further embodiment, the maintenance liquid may be compatible with the ink composition. The ink may be e.g. a latex ink having particles, such as pigment particles and resin particles dispersed therein. When the ink composition and the maintenance liquid are compatible, mixing of the maintenance liquid and the ink may not result in destabilization of the ink composition and the particles dispersed therein.

In an embodiment, step iv) is performed at the start of a period of inactivity of the print head, wherein the method further comprises the steps of:

1. moving the web away from the nozzle surface;
2. at the end of the period of inactivity of the print head, removing the maintenance liquid from the ink chamber and the at least one nozzle.

After the maintenance liquid has been applied to the nozzle surface to prevent evaporation of the liquid vehicle through the nozzles, and optionally has been mixed with fluid already present in the ink chamber, a period of inactivity of the print head may start. When a period of inactivity starts, i.e. a period in which the print head is not in operation, the web may be moved away from the nozzle surface. After the web has been moved away, the nozzle surface of the print head may optionally be capped. Capping may be used to control the atmosphere in which the nozzle surface is placed and may provide additional prevention against evaporation of solvents. When the period of activity is at its end, e.g. when a new print job is sent to the printing apparatus, the print head may be prepared for printing. When printing, it may be undesired that there is still maintenance liquid present in the nozzle, and optionally that maintenance is present in the ink chamber mixed with the ink composition. Therefore, the maintenance liquid may be removed from the ink chamber and the at least one nozzle. For example, the fluid present in the ink chamber and the at least one nozzle may be removed by spitting, such as spitting in the cap. The fluid may also be removed by performing a purge/wipe action. In a purge wipe action, the fluid in the ink chamber is purged through the at least one nozzle. As a result, some of the fluid—i.e. maintenance fluid optionally mixed with ink—may end up on the nozzle surface. By wiping, the fluid may be removed. Wiping may be done e.g. by using a wiper blade, a web, or by both.

Alternatively, in an embodiment, a mixing pulse, or a plurality of mixing pulses may be applied in order to remove the maintenance liquid. By applying a mixing pulse, the fluid as well as the meniscus of the fluid at the nozzle may be brought into motion. By bringing the fluid into motion, fluid may evaporate and thus the maintenance liquid may be removed. If the print head was capped during the period of inactivity, the cap should preferably be removed to allow evaporation of the solvent. No droplet of liquid may be jetted when applying a mixing pulse. However, possibly, some liquid may be transferred to the nozzle surface. Liquid present on the nozzle surface may be removed by performing a first cleaning action. Alternatively, the print head may be purged to remove the liquid in the nozzles and optionally to remove the liquid in the ink chamber. When the maintenance liquid is performed, the print head may start printing again. Optionally, a first or second cleaning action may be performed in between step 2 and start of a print job.

In an embodiment, in step b), the first cleaning action is selected as the maintenance action; and wherein in step c) the method comprising the steps of:

moving the web and the nozzle surface towards one another using the moving means, such that the web contacts the nozzle surface;

moving the web along the nozzle surface.

When performing the first cleaning action, in a first step the nozzle surface and the web may be moved towards one another using the moving means, such that the web contacts the nozzle surface. The print head comprising the nozzle surface may be moved towards the web or the web may be moved towards the nozzle surface, or both the web and the nozzle surface may be moved. At the moment the web contacts the nozzle surface, the web may absorb liquid material present on the nozzle surface. Depending on the relative configuration of the web and the nozzle surface, the web may only contact a part of the nozzle surface or may contact the entire nozzle surface. Liquid present on the nozzle surface may be absorbed by the web locally where the nozzle surface is contacted by the web.

In a second step, the web is moved along the nozzle surface. This may be done by moving the web, by moving the print head comprising the nozzle surface or by moving both the web and the print head comprising the nozzle surface. By moving the web along the nozzle surface, the nozzle surface may be rubbed, thereby removing liquid material from the nozzle surface more efficiently. Moreover, if the web only contacts part of the nozzle surface, the entire nozzle surface may still be cleaned if the web is moved along the nozzle surface.

The web may have a surface that exceeds the surface of the part of the web that contacts the nozzle surface. When the web is moved along the nozzle surface, the part of the web that contacts the nozzle surface may be refreshed. For example, the web may be engaged by a plurality of rollers. For example, the web may be engaged by a web supply roller, said web supply roller engaging the part of the web that has not yet been used in a maintenance action, and a web uptake roller, said web uptake roller engaging the part of the web that has already been used in a maintenance action. When moving along the nozzle surface, the web may simultaneously be moved with respect to the rollers. For example, the web wound around the web supply roller may be partially unwound, and a corresponding part of the web may be wound around the web uptake roller. In that way, the part of the web that is in contact with the nozzle surface may be refreshed. Consequently, spreading of contamination that was absorbed by the web over the nozzle surface may be prevented.

In summary, by performing the first cleaning action, the nozzle surface may be efficiently cleaned.

In an embodiment, in step b), the second cleaning action is selected as the maintenance action; and wherein in step c) the method comprising the steps of:

applying an amount of maintenance fluid to the web;

moving the web and the nozzle surface towards one another using the moving means, such that the web contacts the nozzle surface;

moving the web along the nozzle surface.

When performing the second cleaning action, an amount of maintenance fluid may be applied to the web in a first step. By applying the maintenance fluid to the web, the web may be wetted. After the web has been wetted, the web may be moved towards the nozzle surface in a way as described with reference to the first cleaning action. When the wetted web is brought into contact with the nozzle surface, the web may absorb material present on the nozzle surface. Solid material present on the nozzle surface may dissolve in the maintenance liquid and the resulting liquid, comprising the solid contaminant, may be absorbed by the web. After the web has been brought into contact with the nozzle surface, the web may be moved along the nozzle surface, as described with respect to the first cleaning action. Optionally, the part of the web engaging the nozzle surface may be refreshed by moving the web as described with respect to the first cleaning action. When refreshing the web, the part of the web that is unwound from the web supply roller may be wetted by the wetting means, such that the web is impregnated with the maintenance fluid when it is in contact with the nozzle surface. Thus, by using the second cleaning action, also solid contaminants may be removed from the nozzle surface efficiently.

In an aspect of the invention, a printing apparatus comprising an assembly according to the present invention is provided.

DETAILED DESCRIPTION OF THE DRAWINGS

Figure 1:
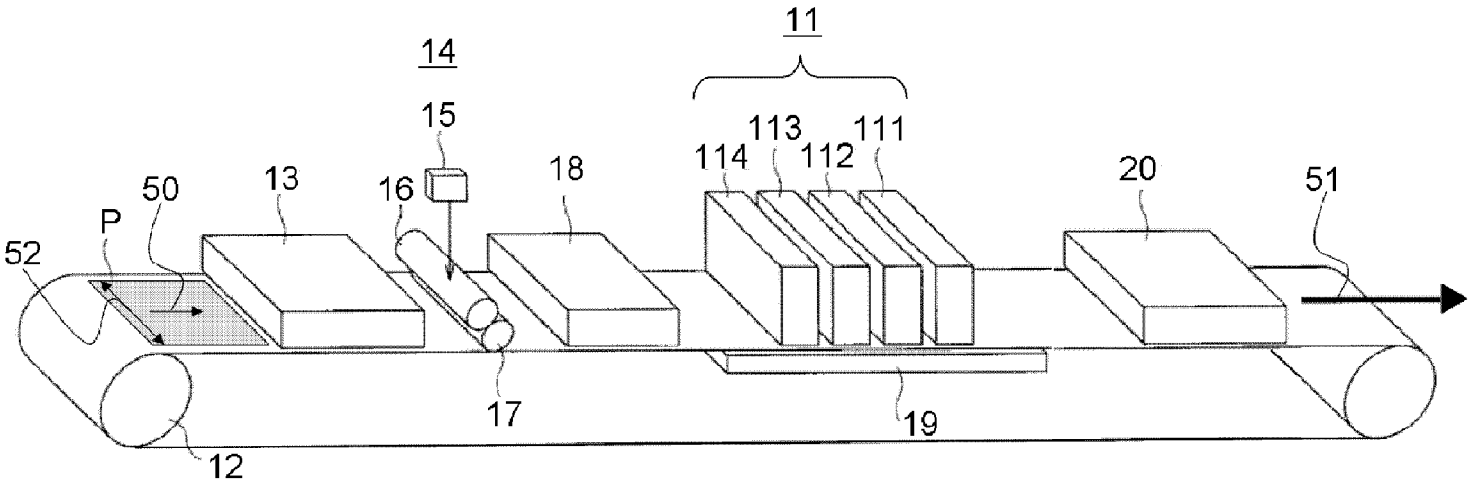
FIG. 1 shows a schematic representation of an inkjet printing system.

In the drawings, same reference numerals refer to same elements.

A printing process in which the inks according to the present invention may be suitably used is described with reference to the appended drawings shown in FIG. 1 and FIG. 2A-C. FIGS. 1 and 2A-C show schematic representations of an inkjet printing system and an inkjet marking device, respectively.

FIG. 1 shows that a sheet of a receiving medium P. The image receiving medium P may be composed of e.g. paper, cardboard, label stock, coated paper, plastic, machine coated paper or textile. Alternatively, the receiving medium may be a medium in web form (not shown). The medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these, vacuum fixation is preferred.

The printing process as described below comprises of the following steps: media pre-treatment, image formation, drying and fixing and optionally post treatment.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the image receiving medium P on which the pre-treatment liquid was supplied may optionally be heated and dried by drying member 18 which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may be comprised multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium. The inkjet inks may be ink jet inks according to the present invention.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is e.g. about 360 dpi. In the present invention, "dpi" indicates a dot number per 2.54 cm.

Figure 2A:
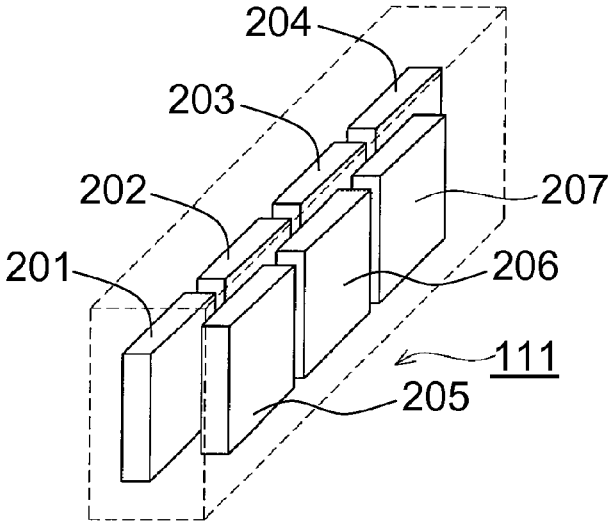
FIGS. 2A-2C show a schematic representation of an inkjet marking device: A) and B) assembly of inkjet heads; C) detailed view of a part of the assembly of inkjet heads.
Figure 2B:
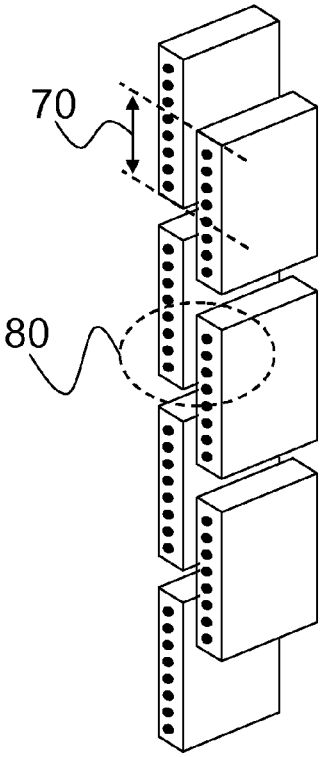
Figure 2C:
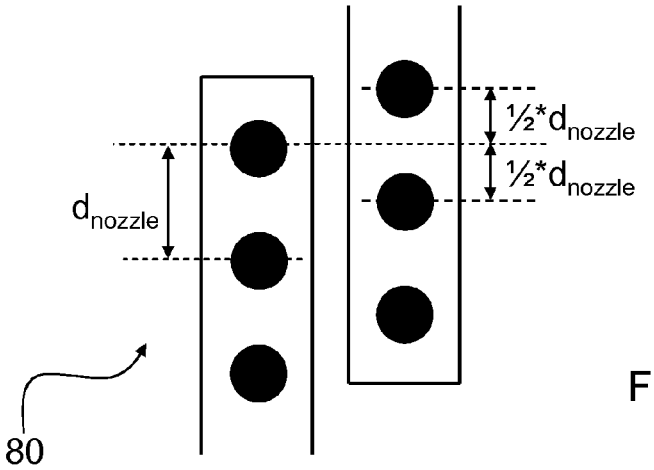

An inkjet marking device for use in single pass inkjet printing, 111, 112, 113, 114, has a length, L, of at least the width of the desired printing range, indicated with double arrow 52, the printing range being perpendicular to the media transport direction, indicated with arrows 50 and 51. The inkjet marking device may comprise a single print head having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of print heads. FIG. 2A shows an inkjet marking device 111 (112, 113, 114 may be identical) comprising 7 individual inkjet heads (201, 202, 203, 204, 205, 206, 207) which are arranged in two parallel rows, a first row comprising four inkjet heads (201-204) and a second row comprising three inkjet heads (205-207) which are arranged in a staggered configuration with respect to the inkjet heads of the first row. The staggered arrangement provides a page wide array of nozzles which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. print head) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to upstream part of the inkjet marking module 11. Then, image formation is carried out by each color ink ejecting from each inkjet marking device 111, 112, 113 and 114 arranged so that the whole width of the image receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 10° C. to 100° C. The temperature control device 19 may comprise heaters, such as radiation heaters, and a cooling means, for example a cold blast, in order to control the surface temperature of the receiving medium within said range. Subsequently and while printing, the receiving medium P is conveyed to the downstream part of the inkjet marking module 11.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a drying and fixing unit 20, which may comprise a heater, for example a radiation heater. After an image has been formed, the print is conveyed to and passed through the drying and fixing unit 20. The print is heated such that solvents present in the printed image, such as water and/or organic co-solvents, evaporate. The speed of evaporation and hence drying may be enhanced by increasing the air refresh rate in the drying and fixing unit 20. Simultaneously, film formation of the ink occurs, because the prints are heated to a temperature above the minimum film formation temperature (MFFT). The residence time of the print in the drying and fixing unit 20 and the temperature at which the drying and fixing unit 20 operates are optimized, such that when the print leaves the drying and fixing unit 20 a dry and robust print has been obtained. As described above, the transportation mechanism 12 in the fixing and drying unit 20 may be separated from the transportation mechanism of the pre-treatment and printing section of the printing apparatus and may comprise a belt or a drum.

Post Treatment

To increase the print robustness or other properties of a print, such as gloss level, the print may be post treated, which is an optional step in the printing process. For example, the prints may be post treated by laminating the prints. Alternatively, the post-treatment step comprises a step of applying (e.g. by jetting) a post-treatment liquid onto the surface of the coating layer, onto which the inkjet ink has been applied, so as to form a transparent protective layer on the printed recording medium.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step or drying an fixing the printed image are performed. It is, however, preferable to carry out image formation with the above defined in-line image forming method.

Figure 3:
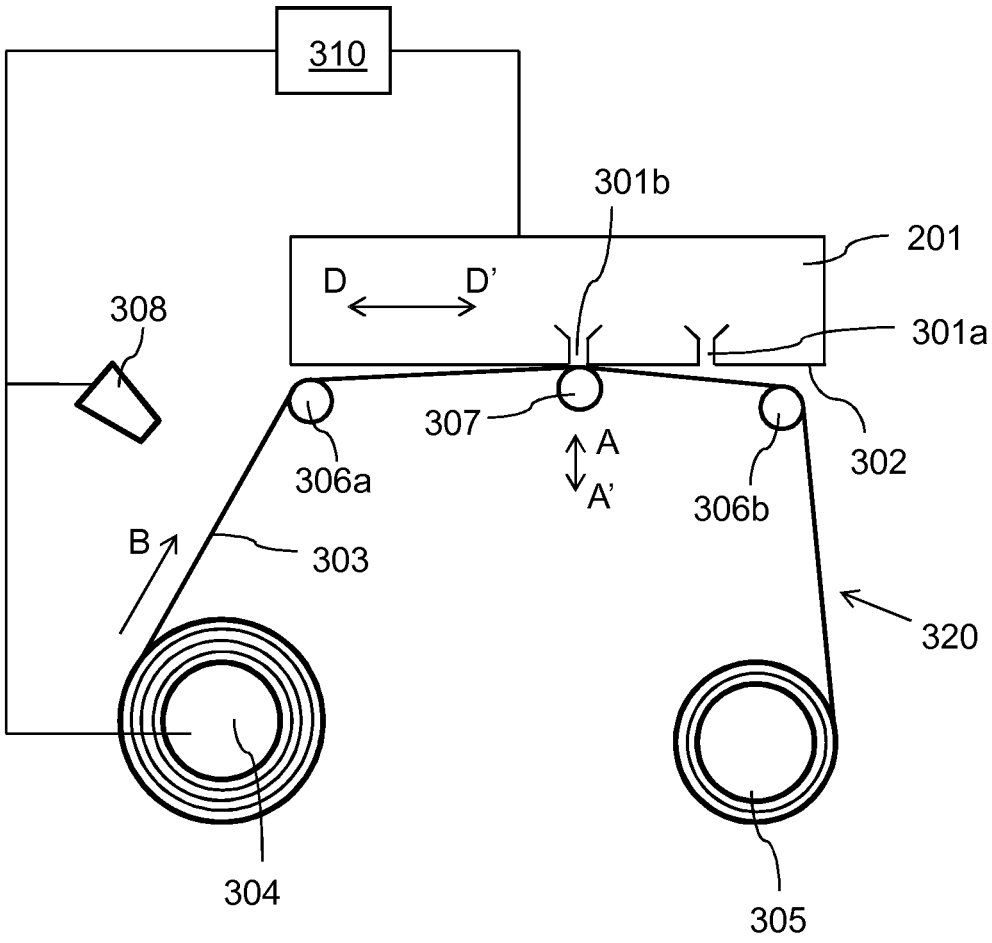
FIG. 3 shows a schematic representation of a first embodiment of an assembly of a print head and a maintenance unit.

FIG. 3 shows an assembly of a maintenance unit 320 and a print head 201 according to a first embodiment of the invention. The print head 201 as shown in FIG. 3 comprises two nozzles, a first nozzle 301*a* and a second nozzle 301*b*. The first nozzle 301*a* and the second nozzle 301*b* will hereafter be referred to as nozzles 301. However, generally, a print head may comprise hundreds of nozzles. The nozzles 301 are positioned in the nozzle surface 302 of the print head 201. The nozzles 301 are in communication with the exterior of the print head 201. The print head 201 comprising the nozzles 301 is in operational communication with the control unit 310. The control unit 310 may be connected to the print head 201. Optionally, the control unit 310 may be connected to a number of print heads, belonging to one printing apparatus or to a plurality of printing apparatus. The control unit 310 and the print head 201 may be connected e.g. via a cable or via a wireless connection. The control unit 310 may provide the print head 201 with print data to enable the print head 201 to eject droplets of a predetermined color in a desired pattern, thereby creating an image.

Figure 4:
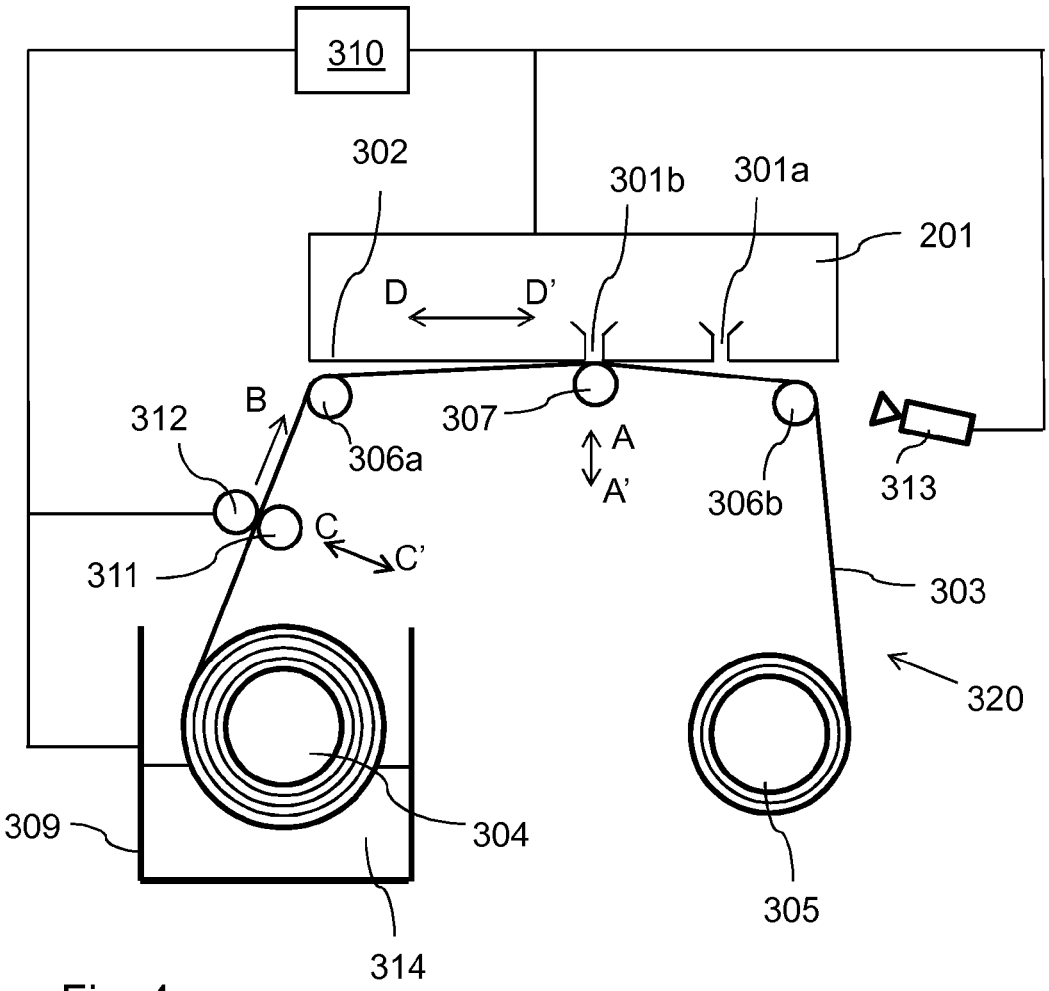
FIG. 4 shows a schematic representation of a second embodiment of an assembly of a print head and a maintenance unit.

The assembly further comprises a maintenance unit 320. The maintenance unit comprises a web 303, which is partially wound around a web supply roller 304 and partially wound around a web uptake roller 305. The web supply roller 304 may be provided with the part of the web 303 that has not yet been used for maintaining the print head 201. The web 303 wound around the web supply roller 304 may therefore be clean web. The part of the web that has already been used for maintaining the print head 201 may not be clean anymore. For example, this part of the web may comprise contaminants that have been removed from the nozzle surface 302 of the print head. This part is wound around the web uptake roller 305, as is depicted in FIG. 4. A part of the web is not wound around the web supply roller 304 or the web uptake roller 305. When a part of the web is unwound by the web supply roller 304, the web may be moved towards the print head 201. The web may be partially unwound from the web supply roller 304 by moving the web supply roller 304 clockwise. The web supply roller 304, as well as the web uptake roller 305, may be driven by suitable driving means (not shown). The part of the web unwound from the web supply roller may be moved in direction B towards the nozzle surface 302 of the print head 201. The part of the web that is in proximity of the nozzle surface 302 is guided by guiding rollers. In FIG. 3, a first guiding roller 306*a* and a second guiding roller 306*b* are depicted; hereinafter referred to as guiding rollers 306. Any suitable number of guiding rollers 306 may be applied to guide the web 303. In addition, as depicted in FIG. 3, the web is engaged by web pressing roller 307. The web pressing roller 307 may move in reciprocation in directions A and A'. By adjusting the web pressing roller 307 the web 303 may be brought into contact with the nozzle surface 302 of the print head 201. Moreover, when the web 303 is brought into contact with the nozzle surface 302, the pressure by which the web 303 is pushed against the nozzle surface 302 may be adjusted by moving the web pressing roller 307 to a suitable distance with respect to the nozzle surface 302. When the web 303 is in contact with the nozzle surface 302, the web 303 and the print head may be moved in direction D/D' with respect to one another. In the embodiment shown in FIG. 3, the print head 201 is movable in the direction D/D'. The print head may be moved by suitable means (not shown). However, alternatively or additionally, the maintenance unit 320 may be moved in the direction D/D'. By moving the web in direction D/D' relative to the nozzle surface, the entire nozzle surface 302 may be maintained. Optionally, during relative movement of the web 303 and the print head 201, the web may be advanced by movement of the web supply roller 304, thereby providing clean web.

The maintenance unit 320 is in functional communication with the control unit 310. The control unit 310 and the maintenance unit 320 may be connected e.g via a cable or via a wireless connection. The control unit may e.g. control the supply of web, the movement of the web pressing roller 307 and the relative movement of the web 303 and the print head 201.

The maintenance unit 320 as shown In FIG. 3 further comprises a spray unit 308. The spray unit 308 is configured to apply maintenance fluid to the web. For example, the spray unit 308 may spray the maintenance liquid to the web 303, but the maintenance liquid may also be applied to the web 303 by means of rollers. By wetting the web 303 with the maintenance liquid, maintenance liquid may be applied to the nozzle surface 302 by contacting the web 303 and the nozzle surface 302. Only one spray unit 308 may be provided, as is shown in FIG. 3, but alternatively two or more spray nozzle units may be provided. For example, two or more spray units may be provided to apply different types of maintenance fluid to the web. For example, a nozzle spray unit may be provided to apply a low volatile maintenance fluid to the web for carrying out a conservation action and another nozzle spray unit may be provided to apply a more volatile maintenance fluid to the web for carrying out a cleaning action. The spray nozzles may be in functional communication with the control unit 310, to allow a desired amount of the desired maintenance liquid or liquids to be provided to the web. The wetting means are in functional communication with the control unit 310. Based on data provided to the spray unit 308, the spray unit provides a suitable amount of maintenance liquid to the web 303 at suitable intervals.

The spray unit 308, the print head 201 and the maintenance unit 320 are operatively connected to the control unit 310. Consequently, the spray unit 308, the print head 201 and the maintenance unit 320 may co-operate in a maintenance action. For example, when the control unit detects a future period of inactivity of the print head, a conservation action may be performed. The control unit 310 may then provide a signal to the spray unit 308 to apply maintenance liquid to the web, provide a signal to the maintenance unit to advance the wetted web and to adjust the web pressing roller 307 to bring the web 303 in contact with the nozzle surface. Moreover, the control unit may provide a signal to the print head to apply an under pressure to the nozzle 301*b*.

FIG. 4 depicts an assembly of a print head 201 and a maintenance unit 320 according to a second embodiment of the invention. The maintenance unit 320 as depicted in FIG. 4 comprises a reservoir 309, said reservoir being filled with maintenance liquid 314. The web supply roller 304 is positioned in the reservoir 309. The web supply roller 304 is partially submerged in the maintenance fluid 314. Therefore, the web wound around the web supply roller 304 is soaked with the maintenance fluid. When the web is moved in direction B towards the nozzle surface 302, the web 303 passes the web squeezing rollers 311, 312. As depicted in FIG. 4 the squeezing roller 311 can be moved in reciprocation in direction C,C', thereby changing the relative position of the squeezing rollers. However, in an alternative embodiment, the squeezing roller 312 may be moved, or both squeezing rollers 311, 312 may be moved relative to one another. By adjusting the relative position of the squeezing rollers 311, 312, a predetermined pressure may be applied to the web 303. As depicted in FIG. 4, the squeezing rollers 311, 312 are positioned close to one another. In this case, a relatively large pressure is applied to the web 303 when it passes the squeezing rollers 311, 312, thereby removing a relatively large amount of the maintenance liquid from the web 303. Alternatively, when the squeezing rollers are further removed from one another, less maintenance fluid may be removed from the web, thereby obtaining a more wetted web 303. The relative position of the squeezing rollers 311, 312 may be suitably selected to obtain a desired amount of maintenance liquid absorbed in the web 303.

The assembly of the print head 201 and the maintenance liquid 320 is further provided with a camera system. The camera system is provided to monitor the status of the print head 201 and its nozzle surface 302. The camera system is operatively connected to the control unit 310. The camera system may thus provide data concerning the status of the print head to the control unit 310. The control unit 310 may subsequently adjust the action of the print head 201 and for the maintenance unit 320, based on the status of the print head 201. Adjustment of the action of the maintenance unit 320 may e.g. involve adjustment of the relative position of the squeezing rollers 311, 312.

Assembly of a print head and a maintenance unit for maintaining the print head, the print head comprising a nozzle surface, the nozzle surface comprising at least one nozzle arranged therein;

the maintenance unit comprising a web, the web being configured to wipe across the nozzle surface of the print head when the web contacts the nozzle surface, the maintenance unit further comprising moving means to move the web with respect to the nozzle surface, the maintenance unit further comprising wetting means for wetting the web with a maintenance fluid;

the assembly being further provided with a control unit configured to control the maintenance unit and the print head, wherein the control unit is configured to, based on a condition of the print head, apply a maintenance action to the print head using the maintenance unit.

In an embodiment, the maintenance action is a conservation action for preventing drying of ink due to evaporation of ink from the at least one nozzle in the nozzle surface, by supplying the nozzle with the maintenance fluid.

In an embodiment, the maintenance action is a first cleaning action for removing liquid material from the nozzle surface.

In an embodiment, the maintenance action is a second cleaning action for removing solid material from the nozzle surface.

In an embodiment, the control unit is configured to, based on a condition of the print head, to selectively apply at least one of the maintenance actions selected from the group consisting of the conservation action, the first cleaning action and the second cleaning action.

In an embodiment, the assembly further comprises a camera system configured to determine the condition of the print head.

In an embodiment, the maintenance fluid is a low volatile fluid.

Method for performing the conservation action according to an embodiment of the invention, the method comprising the steps of:

a) applying an amount of maintenance fluid to the web using the wetting means;

b) moving the web towards the nozzle surface using the moving means, such that the web contacts the nozzle surface at least at the position of the at least one nozzle;

c) applying an under pressure to the at least one nozzle, thereby sucking the fluid from the web into the at least one nozzle.

In an embodiment, the at least one nozzle is in fluid communication with an ink chamber, the ink chamber being positioned in the print head, wherein the print head is provided with at least one actuation unit configured to actuate a fluid present in the ink chamber, wherein the under pressure is applied by the actuation means.

In an embodiment, the method further comprises the step of:

d) applying a mixing pulse to the actuation means, thereby putting a fluid in the ink chamber in motion to mix the fluid sucked from the web with fluid in the ink chamber.

In an embodiment, step c) is repeated after step d) has been performed.

In an embodiment, the maintenance fluid and the fluid in the ink chamber are miscible.

In an embodiment, step d) is performed at the start of a period of inactivity of the print head, wherein the method further comprises the steps of:

1. moving the web away from the nozzle surface;
2. at the end of the period of inactivity of the print head, performing step d) to remove the maintenance fluid from the ink chamber and the at least one nozzle.

Method for performing the conservation action in accordance with the present invention, the method comprising the steps of:

moving the web and the nozzle surface towards one another using the moving means, such that the web contacts the nozzle surface;

moving the web along the nozzle surface.

Method for performing the conservation action in accordance with the present invention, the method comprising the steps of:

applying an amount of maintenance fluid to the web;

moving the web and the nozzle surface towards one another using the moving means, such that the web contacts the nozzle surface;

moving the web along the nozzle surface.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms “a” or “an”, as used herein, are defined as one or more than one. The term plurality, as used herein, is defined as two or more than two. The term another, as used herein, is defined as at least a second or more. The terms including and/or having, as used herein, are defined as comprising (i.e., open language).

The invention claimed is:

1. An assembly of a print head and a maintenance unit for maintaining the print head, the print head comprising a nozzle surface, the nozzle surface comprising at least one nozzle arranged therein;

the maintenance unit comprising a web, the web being configured to wipe across the nozzle surface of the print head when the web contacts the nozzle surface, the maintenance unit further comprising moving means to move the web with respect to the nozzle surface, the maintenance unit further comprising wetting means for wetting the web with a maintenance fluid;

the assembly being further provided with a control unit configured to control the maintenance unit and the print head, wherein the control unit is configured to, based on a condition of the print head, selectively apply a maintenance action to the print head using the maintenance unit, wherein the maintenance action is:

a conservation action for preventing drying of ink due to evaporation of ink from the at least one nozzle in the nozzle surface by supplying the nozzle with the maintenance fluid, wherein during the conservation action, the control unit controls the print head to apply an under pressure to the at least one nozzle to suck fluid from the web into the at least one nozzle.

2. The assembly according to claim 1, wherein the assembly further comprises a camera system configured to determine the condition of the print head.

3. The assembly according to claim 1, wherein the maintenance fluid is a low volatile fluid.

4. A printing apparatus comprising an assembly according to claim 1.

5. A method for maintaining a print head, the print head comprising a nozzle surface, the nozzle surface comprising at least one nozzle arranged therein, wherein the method comprises the steps of:

a) determining a condition of the print head; and b) performing a maintenance action, wherein the maintenance action is a conservation action based on the condition of the print head, wherein the conservation action is configured to supply maintenance fluid to the nozzle to prevent the drying of ink due to evaporation of ink from the at least one nozzle in the nozzle surface, wherein the conservation action is performed using a maintenance unit, the maintenance unit comprising:

a web, the web being configured to wipe across the nozzle surface of the print head when the web contacts the nozzle surface;

a moving means configured to move the web with respect to the nozzle surface; and a wetting means for wetting the web with a maintenance fluid, wherein in step b), the method comprises the steps of:

i) applying an amount of maintenance fluid to the web using the wetting means;

ii) moving the web towards the nozzle surface using the moving means, such that the web contacts the nozzle surface at least at the position of the at least one nozzle; and iii) applying an under pressure to the at least one nozzle, thereby sucking the fluid from the web into the at least one nozzle.

6. The method according to claim 5, wherein the at least one nozzle is in fluid communication with an ink chamber, the ink chamber being positioned in the print head, wherein the print head is provided with at least one actuation unit configured to actuate a fluid present in the ink chamber, wherein the under pressure is applied by the actuation means.

7. The method according to claim 5, wherein the method further comprises the step of:

iv. applying a mixing pulse to the actuation means, thereby putting a fluid in the ink chamber in motion to mix the fluid sucked from the web with fluid in the ink chamber.

8. The method according to claim 7, wherein step iii) is repeated after step iv) has been performed.

9. The method according to claim 7, wherein the maintenance fluid and the fluid in the ink chamber are miscible.

10. The method according to claim 7, wherein step iv) is performed at the start of a period of inactivity of the print head, wherein the method further comprises the steps of:

moving the web away from the nozzle surface; and performing step iv) at the end of the period of inactivity of the print head to remove the maintenance fluid from the ink chamber and the at least one nozzle.

* * * * *